United States Patent [19]

Humphreys et al.

[11] Patent Number: 4,818,426

[45] Date of Patent: Apr. 4, 1989

[54] QUATERNARY AMMONIUM OR PHOSPHONIUM SUBSTITUTED PEROXY CARBONIC ACID PRECURSORS AND THEIR USE IN DETERGENT BLEACH COMPOSITIONS

[75] Inventors: Robert W. R. Humphreys, Oradell, N.J.; Stephen A. Madison, Valley Cottage, N.Y.

[73] Assignee: Lever Brothers Company, New York, N.Y.

[21] Appl. No.: 174,735

[22] Filed: Mar. 30, 1988

Related U.S. Application Data

[63] Continuation of Ser. No. 27,278, Mar. 17, 1987, Pat. No. 4,751,015.

[51] Int. Cl.[4] ..... C11D 3/395

[52] U.S. Cl. ..... 252/99; 252/186.1; 252/186.21; 544/139; 544/168; 546/222; 546/292; 546/301; 558/263; 558/271; 560/157

[58] Field of Search ..... 558/263, 270, 271, 275, 558/276; 560/163, 165, 157, 302; 544/139, 168, 171, 370, 384, 399, 400; 546/210, 222, 232, 233, 238, 242, 247, 248, 278, 291, 292, 301, 336, 337, 341, 342; 548/309, 311, 551, 556, 567, 572, 573

[56] References Cited

U.S. PATENT DOCUMENTS

| | | | |
|---|---|---|---|
| 3,256,198 | 6/1966 | Matzner | 252/99 |
| 3,272,750 | 9/1966 | Chase | 252/99 |
| 3,686,127 | 8/1972 | Boldingh et al. | 252/99 |
| 4,260,529 | 4/1981 | Letton | 252/547 |
| 4,283,301 | 8/1981 | Diehl | 252/102 |
| 4,397,757 | 8/1983 | Bright et al. | 252/186.41 |
| 4,412,934 | 11/1983 | Chung et al. | 252/186.38 |
| 4,483,778 | 11/1984 | Thompson et al. | 252/94 |
| 4,486,327 | 12/1984 | Murphy et al. | 252/94 |
| 4,536,314 | 8/1985 | Hardy et al. | 252/102 |

FOREIGN PATENT DOCUMENTS

| | | |
|---|---|---|
| 98129 | 1/1984 | European Pat. Off. . |
| 106584 | 4/1984 | European Pat. Off. . |
| 106634 | 4/1984 | European Pat. Off. . |
| 120591 | 10/1984 | European Pat. Off. . |
| 163331 | 12/1985 | European Pat. Off. . |
| 166571 | 1/1986 | European Pat. Off. . |
| 170386 | 2/1986 | European Pat. Off. . |
| 185522 | 6/1986 | European Pat. Off. . |
| 202698 | 11/1986 | European Pat. Off. . |
| 836988 | 6/1960 | United Kingdom . |
| 864798 | 4/1961 | United Kingdom . |

OTHER PUBLICATIONS

"Dipolar Micelles. 9. The Mechanism of Hydrolysis of Cationic Long Chained Benzoate Esters in Choline and Homocholine-Type Micelles", by A. Pillersdorf, Israel Journal of Chemistry, vol. 18, 1979, pp. 330-338.

"The Reactivity of Substrate Functionalized Surfactant Vesicles", by Moss et al., Tetrahedron Letters, vol. 26, No. 51, pp. 6305-6308 (1985).

*Primary Examiner*—Paul Lieberman

*Assistant Examiner*—Kathleen Markowski

*Attorney, Agent, or Firm*—Milton L. Honig; James J. Farrell

[57] ABSTRACT

A bleach precursor compound, its peroxygen acid derivative, and detergent compositions containing these materials are disclosed herein. The bleach precursor structurally comprises a quaternized ammonium or phosphonium group linked to a carbonate moiety having a leaving group. Upon perhydrolysis in the presence of hydrogen peroxide and a basic aqueous media, there is generated a peroxycarbonic acid bleach.

41 Claims, No Drawings

QUATERNARY AMMONIUM OR PHOSPHONIUM SUBSTITUTED PEROXY CARBONIC ACID PRECURSORS AND THEIR USE IN DETERGENT BLEACH COMPOSITIONS

This is a continuation of Ser. No. 027,278, filed Mar. 17, 1987, now U.S. Pat. No. 4,751,015, issued June 14, 1988.

BACKGROUND OF THE INVENTION

1. Field of the Invention

The invention relates to novel bleach precursors, peracids generated therefrom and use of these materials in detergent compositions.

2. The Prior Art

It is well known that active oxygen-releasing compounds are effective bleaching agents. These compounds are frequently incorporated into detergent compositions for stain and soil removal. Unlike the traditional sodium hypochlorite bleaches, oxygen-releasing compounds are less aggressive and thus more compatible with detergent compositions. They have, however, an important limitation; the activity of these compounds is extremely temperature dependent. Thus, oxygen-releasing bleaches are essentially only practical when the bleaching solution is heated above 60° C. At a temperature of just 60° C., extremely high amounts of the active oxygen-releasing compounds must be added to the system to achieve any bleach effect. Although this would indicate the desirability of high temperature operation, high temperatures are both economically and practically disadvantageous.

At bleach solution temperatures below 60° C., the active oxygen-releasing compounds are rendered much less effective regardless of their level in the system. With respect to bleaching of laundry in automatic household washing machines, it must be noted that these machines are normally operated at wash-water temperatures below 60° C. Consequently, there has developed a need for substances which promote release of active oxygen at temperatures below 60° C. These substances are generally referred to in the art as bleach precursors, although they have also been called promoters and activators. Normally, bleach precursors are used in conjunction with persalts capable of releasing hydrogen peroxide in aqueous solution, perborate being the most widely used persalt.

Typically, the precursor is a reactive compound such as a carboxylic acid ester that in alkaline detergent solution containing a source of hydrogen peroxide, e.g. a persalt, will generate the corresponding peroxy acid. The reaction involves nucleophilic substitution onto the precursor by hydroperoxy anions ($HOO^-$) and is facilitated by precursors having good leaving groups. Often the reaction is referred to as a perhydrolysis.

Early patents in the area of precursor chemistry include U.S. Pat. No. 3,256,198 (Matzner) and U.S. Pat. No. 3,272,750 (Chase) each of which suggest the use of organic carbonate esters as bleach aids. British Pat. No. 836,988 (Davies et al.) and British Pat. No. 864,798 (Hampson et al.) were forerunners disclosing the use of aliphatic carboxylic acid esters as adjuncts for accelerating the bleaching of persalts such as sodium perborate or percarbonate.

U.S. Pat. No. 4,283,301 (Diehl) discloses a peroxygen bleach and a precursor of the general formula:

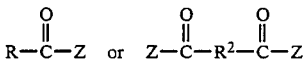

wherein R is an alkyl chain containing from 5 to 13 carbon atoms, $R^2$ is an alkyl chain containing from 4 to 24 carbon atoms and each Z is a leaving group as defined therein.

U.S. Pat. No. 4,412,934 (Chung et al.) reports compositions incorporating bleach precursors of the general formula:

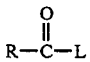

wherein R is an alkyl group containing from 5 to 18 carbon atoms and L is a leaving group.

Similar disclosures are found in U.S. Pat. No. 4,486,327 (Murphy et al.), EP No. 0 098 129 (Hardy et al.), EP No. 0 106 584 (Hartman), EP No. 0 106 634 (Chung et al.), EP No. 0 120 591 (Hardy et al.), EP No. 0 163 331 (Burns et al.), EP No. 0 166 571 (Hardy et al.), EP No. 0 185 522 (Fong et al.), EP No. 0 170 386 (Burns et al.), EP No. 0 153 222 (Moyne et al.), EP No. 0 153 223 (Moyne et al.), and EP No. 0 202 698 (Nollet et al.). Among the preferred leaving groups are those having solubilizing functionality including sufonic, sulfuric, carboxylate and quaternary ammonium salt groups.

A typical precursor within the concept of the aforedescribed patents is sodium n-nonanoyloxbenzene sulfonate presently commercialized as a component of a branded detergent. This sulfonate, in combination with sodium perborate, effectively releases peroxygen fragments upon perhydrolysis, as well as sodium 4-sulfophenol. Once released, the p-sulfophenol fragment unfortunately provides no additional fabric washing benefit.

Esters such as sodium n-nonanoyloxybenzene sulfonate are reported to require greater than stoichiometric amounts of alkaline hydrogen peroxide. For example, U.S. Pat. No. 4,536,314 (Hardy et al.) discloses hydrogen peroxide/activator ratios ranging from greater than 1:5:1 to 10:1. High peroxide ratios are necessary with these activators to ensure high rates of peracid formation and to account for the unavoidable depletion of peroxide by natural soils. These high ratios are economically wasteful.

U.S. Pat. No. 3,686,127 (Boldingh et al.) recognizes the shortcomings of precursors whose leaving groups provide no additional fabric washing benefit. Therefore, the patent suggests use of alkylated sulfophenol carboxylic esters which release leaving groups that provide detergent and emulsifying properties. However, with this modification to the leaving group structure, the yield of peracid falls to essentially non-useful levels. For instance, sodium 2-acetoxy-5-hexylbenzenesulfonate yields 43% peracid after 5 minutes but the unsubstituted derivative yields 80% peracid. Presumably, unfavorable steric or electrostatic interactions arising from the alkyl substituents retard the rate of perhydrolysis.

U.S. Pat. No. 4,397,757 (Bright et al.) reports that having quaternary ammonium groups on the precursor is advantageous because it allows precursor and intermediate species to substantively attach onto srfaces undergoing bleaching, e.g. fabric surfaces. Substativity was said to lead to enhanced stain removal, particularly at low temperature. A drawback of this technology is the expense in preparing the precursors; the synthesis involves several steps and requires excess reagent. Starting materials are also not readily available.

While the aforementioned precursors have all been reported effective at stain removal, there is still a need for more efficient systems. Stain removal efficiency may be improved either by a precursor that generates equivalent bleach at a lower precursor molar level or operates at lower levels of hydrogen peroxide source. Not only do lower levels of peroxide source or precursor provide better economics, theyalso permit increased flexibility in detergent formulation.

Consequently, it is an object of the present invention to provide a detergent-bleach composition with a precursor that permits bleaching over a wide temperature range including that of under 60° C.

It is another object of the present invention to provide certain novel bleach precursors which have hitherto not been described in the art.

A further object of the present invention is to provide a precursor having a group capable of imparting additional benefits to treated substances including that of detergency and/or fabric softening while still achieving high peracid generating levels.

Another object of the present invention is to provide a precursor that can be economically synthesized from readily available starting materials and in a minimum number of synthetic steps.

A final object of the present invention is to provide novel peroxy acids generated from the bleach precursors by perhydrolysis with hydrogen peroxide or persalts.

SUMMARY OF THE INVENTION

A bleach precursor compound is provided having the formula:

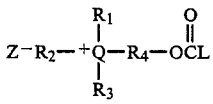

(I)

wherein:

$R_1$, $R_2$ and $R_3$ are each a radical selected from the group consisting of alkyl, alkenyl, alkynyl, cycloalkyl, cycloalkenyl, alkaryl, aryl, phenyl, hydroxyalkyl, polyoxyalkylene and $R_4OCOL$;

or two or more of $R_1$, $R_2$, and $R_3$ together form an alkyl substituted or unsubstituted nitrogen-containing heterocyclic ring system;

or at least one of $R_1$, $R_2$, and $R_3$ is attached to $R_4$ to form an alkyl substituted or unsubstituted nitrogen-containing heterocyclic ring system;

$R_4$ is selected from the bridging group consisting of alkylene, cycloalkylene, alkylenephenylene, phenylene, arylene, and polyalkoxylene and wherein the bridging group can be unsubstituted or substituted with $C_1$–$C_{20}$ alkyl, alkenyl, benzyl, phenyl and aryl radicals;

$Z^-$ is a monovalent or multivalent anion leading to charge neutrality when combined with $Q^+$ in the appropriate ratio and wherein $Z^-$ is sufficiently oxidatively stable not to interfere significantly with bleaching by a peroxy carbonic acid;

Q is nitrogen or phosphiorous; and

L is a leaving group, the conjugate acid of which has a $pK_a$ in the range of from 6 to about 13.

A peroxygen acid is also provided having the formula:

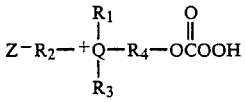

(II)

Furthermore, a detergent-bleaching composition is provided comprising:

(i) from 1 to 60% of a peroxygen compound capable of yielding hydrogen peroxide in an aqueous solution;

(ii) from 0.1 to 40% of the bleach precursor of formula I described hereinabove;

(iii) from 0 to 50% of a surfactant; and (iv) from 0 to 70% of a detergent builder.

DETAILED DESCRIPTION OF THE INVENTION

There have now been discovered a novel group of compounds having the formula:

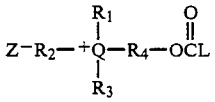

(I)

which meet many of the objectives outlined. Peroxy carbonic acid precursors of the formula I have been found tto generate peroxy carbonic acids that are superior bleaching agents, giving substantially higher levels of stain removal for a given level of persalt than observed with known precursors.

A most important component of precursor compound (I) is the leaving group (L). Leaving groups of the appropriate structure facilitate reaction of the bleach precursor with hydrogen peroxide in basic aqueous solution to generate a peroxy carbonic acid bleach as follows:

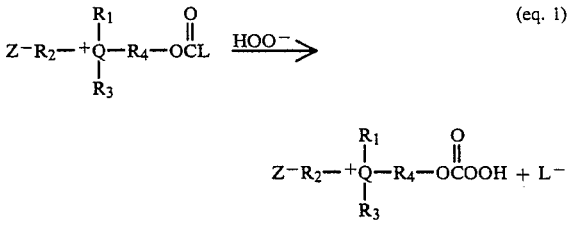

(eq. 1)

Leaving groups effective for the present invention will induce rapid formation of the peroxy carbonic acid in the presence of a peroxygen source under practical conditions, e.g., in detergent solution during laundering of clothes. Generally, L must be of an electron attracting structure which promotes successful nucleophilic attack by the perhydroxide anion. Leaving groups which exhibit such properties are those in which the conjugate acid has a $pK_a$ in the range of from about 6 to about 13, preferably from about 7 to about 11, most preferably from about 8 to about 11.

Many and diverse leaving group structures have been described in the patentliterature and are useful for this invention. For example, U.S. Pat. No. 4,412,934, U.S. Pat. No. 4,483,778, European Patent Application No.

170,386 and European Patent Application No. 166,571 provide examples of desirable leaving groups, and are herein incorporated by reference.

Illustrative of the leaving structures L are those selected from the group consisting of:

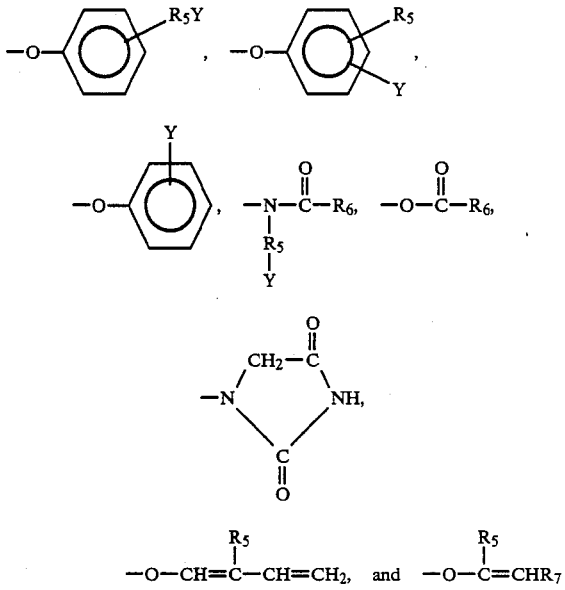

wherein $R_5$ and $R_6$ are a $C_1$–$C_{12}$ alkyl group, $R_7$ is H or $R_5$, and Y is H or a water solubilizing group. Preferred solubilizing groups are $-SO^-{}_3M^+$, $-COO^-M^+$, $-SO^-{}_4M^+$, $-N^+(R_5)_3X^-$, $NO_2$, OH, and $O\leftarrow N(R_5)_2$ and mixtures thereof;

wherein $M^+$ is a hydrogen, alkali metal, ammonium or alkyl or hydroxyalkyl substituted ammonium cation. $X^-$ is a halide, hydroxide, phosphate, sulfate, methyl sulfate or acetate anion.

Most preferred of the leaving groups is the phenol sulfonate type. Especially preferred is the 4-sulphophenol group. Sodium, potassium and ammonium cations are the preferred counterions to the sulphophenol structures.

Although phosphonium groups where Q is phosphorous is within the scope of this invention, for economic reasons it is most preferred that Q be nitrogen. Furthermore, the precursor and respective peracid derivative compounds should preferably contain a quaternary ammonium carbon surrounded by $R_1$, $R_2$ and $R_3$ each the same or different and having $C_1$–$C_{20}$ atom radicals selected from the group consisting of alkyl, alkylaryl, benzyl, hydroxyalkyl, heterocyclic rings containing the quaternary nitrogen groups where $R_1$ and $R_4$ or $R_1$ and $R_2$ are joined together, and mixtures of groups thereof.

In particular, it is desirable that $R_1$ be a short-chain $C_1$–$C_4$ alkyl radical, preferably methyl, while $R_2$ and $R_3$ be a longer chain $C_7$–$C_{20}$ alkyl or alkylaryl, such as stearyl, lauryl, or benzyl group. With regard to the $R_4$ bridge between the quaternary nitrogen and carbonate groups, it is desirable that $R_4$ be a bridging group selected from $C_2$–$C_{20}$ alkylene, $C_6$–$C_{12}$ phenylene, $C_5$–$C_{20}$ cycloakylene, and $C_8$–$C_{20}$ alkylenephenylene groups. Preferably, the alkylene groups should have 2 carbon atoms. Further, the bridging group can be unsubstituted or substituted with $C_1$–$C_{20}$ alkyl, alkenyl, benzyl, phenyl and aryl radicals.

The preferred precursor and peroxygen acid derivative compounds are exemplified by structures III and IV.

Within the context of this invention, there may be compounds having the general structure (I) where $R_1$ and $R_4$ together or $R_1$ and $R_2$ together form an alkyl substituted or unsubstituted nitrogen-containing heterocyclic ring system. Representative of these systems are rings defining pyridine, morpholine, pyrrolidine, piperidine and piperazine.

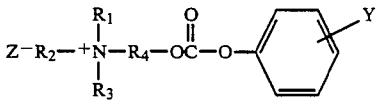

(III)

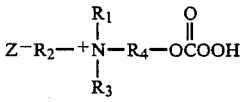

(IV)

The following compounds are illustrative of precursors within the present invention. It is also to be understood that upon perhydrolysis elimination of the leaving group, as defined above, there remains an organic peroxygen acid derivative of the structures outlined below.

2-(N-benzyl-N,N-dimethylammonium)ethyl sodium 4-sulfophenyl carbonate chloride.

2-(N,N,N-trimethylammonium)ethyl sodium 4-sulfophenyl carbonate chloride 2-(N,N-ditallow-N-methylammonium)ethyl sodium 4-sulfophenyl carbonate chloride 3-(N-nonyl-N,N-dimethylammonium)propyl sodium 2-sulfophenyl carbonate chloride 2-(N-benzyl-N,N-diethylammonium)ethyl sodium 2-sulfophenyl carbonate methosulfate 2-(N-benzyl-N,N-dimethylammonium)ethyl disodium 2,4-disulfophenyl carbonate methosulfate 2-(N-butyl-N,N-dimethylammonium)ethyl sodium 4-carboxyphenyl carbonate bromide 2-(N-stearyl-N,N-diethylammonium)ethyl 2-triethanolammoniumphenyl carbonate dichloride 2-(N-diethylhexyl-N-N-dimethylammonium)ethyl 2-(dimethyl amine oxide)phenyl carbonate chloride 2-(N,N,N-triethylammonium)ethyl disodium 2,4-disulfophenyl carbonate methosulfate 4-(N,N,N-trimethylammonium)butyl sodium 4-sulfophenyl carbonate bromide 2-(N,N,N-tributylammonium)ethyl sodium 4-triethanolammoniumphenyl carbonate dichloride 2-(N,N,N-trimethylammonium)ethyl sodium 4-(diethylamine oxide)phenyl carbonate chloride 2-(N,N,N-tribenzylammonium)ethyl 4-carboxyphenyl carbonate methosulfate 1-(N,N-dihexyl-N-methylammonium)-3-phenyl-2-propyl disodium 2,4-disulfophenyl carbonate chloride 2-(N,N,N-tributylammonium)-3-(4-hexylphenyl)-1-propyl sodium 4-sulfophenyl carbonate chloride 6-[(N,N,N-triethylammonium)methyl]-6-dodecyl sodium carboxyphenyl carbonate chloride 2-(N,N-didodecyl-N-etylammonium)propyl sodium 4-sulfophenyl carbonate chloride 2-[N-benzyl-N-(2-hydroxyethyl)-N-dodecylammonium]ethyl sodium 4-sulfophenyl carbonate chloride 2-(N-decyl-N,N-diethylammonium)ethyl 4-sulfophenyl sodium carbonate chloride 4-(N-phenyl-N,N-didodecylammonium)butyl sodium 4-sulfophenyl carbonate chloride
5-(N-dodecyl-N,N-dimethylammonium)-6-dodecyl sodium 4-sulfophenyl carbonate chloride
2-[2-dodecyl-4-(N,N,N-triethylammonium)phenyl-]ethyl sodium 4-sulfophenyl carbonate chloride
Sodium N-[2-(4-sulfophenoxycarbonyloxy)ethyl]-4-decylpyridinium chloride
Sodium N-[2-(4-sulfophenoxycarbonyloxy)ethyl-]imidazolium chloride
Disodium bis[(4-sulfophenoxycarbonyloxy)ethyl]methyldodecyl ammonium chloride
Trisodium tris[(4-sulfophenoxycarbonyloxy)ethyl]-dodecyl ammonium chloride
2-(N,N,N-trimethylammonium)tetradecyl sodium 4-sulfophenyl carbonate chloride
2-(N-octyl-N,N-dimethylammonium)ethyl sodium 4-sulfophenyl carbonate chloride
2-(N,N-didecyl-N-methylammonium)ethyl sodium 4-sulfophenyl carbonate chloride
2-(N-benzyl-N-dodecyl-N-methylammonium)ethyl sodium 4-sulfophenyl carbonate chloride
2-(N,N,N-trioctylammonium)ethyl sodium 4-sulfophenyl carbonate chloride
1-(N,N,N-trimethylammonium)-2-dodecyl sodium 4-sulfophenyl carbonate chloride
1-(N-benzyl-N,N-diethylammonium)-3-dodecyl sodium 4-sulfophenyl carbonate chloride
1-(N-benzyl-N,N-dibutylammonium)-2-octyl sodium 4-carboxyphenyl carbonate chloride
2-(N,N,N-trihexylammonium)-1-phenylethyl 4-(dimethylamine oxide)phenyl carbonate chloride
12-(N,N,N-triethylammonium)dodecyl 4-triethanolammoniumphenyl carbonate dichloride
2-(N-hexyl-N,N-dimethylammonium)ethyl sodium 4-sulfophenyl carbonate methosulfate
2-(benzyldimethylphosphonium)ethyl sodium 4-sulfophenyl carbonate chloride
2-(trimethylphosphonium)ethyl sodium 4-sulfophenyl carbonate chloride
2-(ditallowmethylphosphonium)ethyl sodium 4-sulfophenyl carbonate chloride
3-(nonyldimethylphosphonium)propyl sodium 2-sulfophenyl carbonate chloride
2-(benzyldietylphosphonium)ethyl sodium 2-sulfophenyl carbonate methosulfate
2-(benzyldimethylphosphonium)ethyl disodium 2,4-disulfophenyl carbonate methosulfate
2-(butyldimethylphosphonium)ethyl sodium 4-carboxyphenyl carbonate bromide
2-(stearyldiethylphosphonium)ethyl 2-triethanolammoniumphenyl carbonate dichloride
2-(diethylhexyldimethylphosphonium)ethyl 2-dimethyl amine oxide)phenyl carbonate chloride
2-(triethylphosphonium)ethyl disodium 2,4-disulfophenyl carbonate methosulfate
4-(trimethylphosphonium)butyl sodium 4-sulfophenyl carbonate bromide
2-(tributylphosphonium)ethyl sodium 4-triethanolammoniumphenyl carbonate dichloride
2-(trimethylphosphonium)ethyl 4-(diethylamine oxide)-phenyl carbonate chloride
2-(tribenzylphosphonium)ethyl sodium 4-carboxyphenyl carbonate methosulfate.
1-(dihexyl methylphosphonium)-3-phenyl-2-propyl disodium 2,4-disulfophenyl carbonate chloride
2-(tributylphosphonium)-3-(4-hexylphenyl)-1-propyl sodium 4-sulfophenyl carbonate chloride
6-[(triethylphosphonium)methyl]-6-dodecyl sodium carboxyphenyl carbonate chloride
2-(didodecyl ethylphosphonium)propyl sodium 4-sulfophenyl carbonate chloride
2-[benzyl(2-hydroxyethyl)dodecylphosphonium]ethyl sodium 4-sulfophenyl carbonate chloride
2-(decyl diethylphosphonium)ethyl 4-sulfophenyl sodium carbonate chloride
4-(phenyl didodecylphosphonium)butyl sodium 4-sulfophenyl carbonate chloride
5-(dodecyl dimethylphosphonium)-6-docecyl sodium 4-sulfophenyl carbonate chloride
2-[2-dodecyl-4-(triethylphosphonium)phenyl]ethyl sodium 4-sulfophenyl carbonate chloride
Disodium bis[(4-sulfophenoxycarbonyloxy)ethyl]methyldodecyl phosphonium chloride
Trisodium tris[(4-sulfophenoxycarbonyloxy)ethyl]-dodecyl phosphonium chloride
2-(trimethylphosphonium)tetradecyl sodium 4-sulfophenyl carbonate chloride
2-(octyl dimethylphosphonium)ethyl sodium 4-sulfophenyl carbonate chloride
2-(didecyl methylphosphonium)ethyl sodium 4-sulfophenyl carbonate chloride
2-(benzyl dodecyl methylphosphonium)ethyl sodium 4-sulfophenyl carbonate chloride
2-(trioctylphosphonium)ethyl sodium 4-sulfophenyl carbonate chloride
1-(trimethylphosphonium)-2-dodecyl sodium 4-sulfophenyl carbonate chloride
1-(benzyl diethylphosphonium)-3-dodecyl sodium 4-sulfophenyl carbonate chloride
1-(benzyl dibutylphosphonium)-2-octyl sodium 4-carboxyphenyl carbonate chloride
2-(trihexylphosphonium)-1-phenylethyl 4-(dimethylamine oxide)phenyl carbonate chloride
12-(triethylphosphonium)dodecyl 4-triethanolammoniumphenyl carbonate dichloride
2-(hexyl dimethylphosphonium)ethyl sodium 4-sulfophenyl carbonate methosulfate Precursors of the present invention represent a new class of quaternary ammonium and phosphonium substituted peroxy carbonic acid bleaches. The precursors described by structure (I) generate the corresponding percarbonic acids rapidly in the presence of hydrogen peroxide or hydrogen peroxide generating persalts such as sodium perborate. Outstanding bleaching is achieved on hydrophilic stains such as tea and red wine. Effective bleaching of tea and red wine stains may occur as low as 20° C. and even be perceptible at 10° C. Good bleaching is obtained even at a low molar ratio of hydrogen peroxide to precursor (as low as 1:1) or at a low theoretical percarbonic acid level (5 ppm active oxygen). Typically, the ratio of hydrogen peroxide (or a peroxygen compound generating the equivalent amount of $H_2O_2$) to precursor will range from 0.5:1 to 10:1, preferably 1:1 to 4:1, most preferably 1:1 to less than 1.5:1. Hydrophobic type stains such as that imparted by spaghetti sauce may even successfully be attacked by appropriate members of the herein disclosed peroxy carbonic acid class. Thus, the precursors of the invention provide effective color safe, cold water bleaching systems.

Although not to be bound by any theory, it is believed that the quaternary ammonium or phosphonium group enhances the interaction between bleach and the negatively charged fabric surface in detergent solution. Moreover, it is believed that the higher electrophilicity of the peroxy carbonic relative to the peroxy carboxylic type acid functions to increase oxidative power against stains. Thus, peroxy carbonic acid and ester precursors are performance distinguished from known systems such as described in U.S. Pat. No. 4,397,757 and U.S. Pat. No. 4,412,934.

The foregoing precursors may be incorporated into detergent bleach compositions which require as an essential component a peroxygen bleaching compound capable of yielding hydrogen peroxide in an aqueous solution.

Hydrogen peroxide sources are well known in the art. They include the alkali metal peroxides, organic peroxide bleaching compounds such as urea peroxide, and inorganic persalt bleaching compounds, such as the alkali metal perborates, percarbonates, perphosphates and persulfates. Mixtures of two or more such compounds may also be suitable. Particularly preferred are sodium perborate tetrahydrate and, especially, sodium perborate monohydrate. Sodium perborate monohydrate is preferred because it has excellent storage stability while also dissolving very quickly in aqueous bleaching solutions. Rapid dissolution is believed to permit formation of higher levels of percarboxylic acid which would enhance surface bleaching performance.

A detergent formulation containing a bleach system consisting of an active oxygen releasing material and a novel compound of the invention will usually also contain surface-active materials, detergency builders and other known ingredients of such formulations.

The surface-active material may be naturally derived, such as soap, or a synthetic material selected from anionic, nonionic, amphoteric, zwitterionic, cationic actives and mixtures thereof. Many suitable actives are commercially available and are fully described in the literature, for example in "Surface Active Agents and Detergents", Volumes I and II, by Schwartz, Perry and Berch. The total level of the surface-active material may range up to 50% by weight, preferably being from about 1% to 40% by weight of the composition, most preferably 4 to 25%.

Synthetic anionic surface-actives are usually water-soluble alkali metal salts of organic sulphates and sulphonates having alkyl radicals containing from about 8 to about 22 carbon atoms, the term alkyl being used to include the alkyl portion of higher aryl radicals.

Examples of suitable synthetic anionic detergent compounds are sodium and ammonium alkyl sulphates, especially those obtained by sulphating higher ($C_8$–$C_{18}$) alcohols produced for example from tallow or coconut oil; sodium and ammonium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty acid monoglyceride sulphates and sulphonates; sodium and ammonium salts of sulphuric acid esters of higher ($C_9$–$C_{18}$) fatty alcohol-alkylene oxide, particularly ethylene oxide, reaction products; the reaction products of fatty acids such as coconut fatty acids esterified with isethionic acid and neutralized with sodium hydroxide; sodium and ammonium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolyzing with a base to produce a random sulphonate; sodium and ammonium $C_7$–$C_{12}$ dialkyl sulfosuccinates; and olefin sulphonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkylbenzene sulphonates, sodium ($C_{16}$–$C_{18}$) alkyl sulphates and sodium ($C_{16}$–$C_{18}$) alkyl ether sulphates.

Examples of suitable nonionic surface-active compounds which may be used, preferably together with the anionic surface-active compounds, include in particular the reaction products of alkylene oxides, usually ethylene oxide, with alkyl ($C_6$–$C_{22}$) phenols, generally 5–25 EO, i.e. 5–25 units of ethylene oxides per molecule; the condensation products of aliphatic ($C_8$–$C_{18}$) primary or secondary linear or branched alcohols with ethylene oxide, generally 6–30 EO, and products made by condensation of ethylene oxide with the reaction products of propylene oxide and ethylene diamine. Other so-called nonionic surface-actives include alkyl polyglycosides, long chain tertiary amine oxides, long chain tertiary phosphine oxides and dialkyl sulphoxides.

Amounts of amphoteric or zwitterionic surface-active compounds can also be used in the compositions of the invention but this is not normally desired owing to their relatively high cost. If any amphoteric or zwitterionic detergent compounds are used, it is generally in small amounts in compositions based on the much more commonly used synthetic anionic and nonionic actives.

As stated above, soaps may also be incorporated into the compositions of the invention, preferably at a level of less than 30% by weight. They are particularly useful at low levels in binary (soap/anionic) or ternary mixtures together with nonionic or mixed synthetic anionic and nonionic compounds. Soaps which are used are preferably the sodium, or less desirably potassium, salts of saturated or unsaturated $C_{10}$–$C_{24}$ fatty acids or mixtures thereof. The amount of such soaps can be varied between about 0.5% and about 25% by weight, with lower amounts of about 0.5% to about 5% being generally sufficient for lather control. Amounts of soap between about 2% and about 20%, especially between about 5% and about 15%, are used to give a beneficial effect on detergency. This is particularly valuable in compositions used in hard water when the soap acts as a supplementary builder.

The detergent compositions of the invention will normally also contain a detergency builder. Builder materials may be selected from (1) calcium sequestrant materials, (2) precipitating materials, (3) calcium ion-exchange materials and (4) mixtures thereof.

Examples of calcium sequestrant builder materials include alkali metal polyphosphates, such as sodium tripolyphosphate; nitrilotriacetic acid and its water-soluble salts; the alkali metal salts of carboxymethyloxy succinic acid, ethylene diamine tetraacetic acid, oxydisuccinic acid, mellitic acid, benzene polycarboxylic acids, citric acid; and polyacetalcarboxylates as disclosed in U.S. Pat. Nos. 4,144,226 and 4,146,495.

Examples of precipitating builder materals include sodium orthophosphate, sodium carbonate and long-chained fatty acid soaps.

Examples of calcium ion-exchange builder materials include the various types of water-insoluble crystalline or amorphous aluminosilicates, of which zeolites are the best known representatives.

In particular, the compositions of the invention may contain any one of the organic or inorganic builder materials, such as sodium or potassium tripolyphosphate, sodium or potassium pyrophosphate, sodium or potassium orthophosphate, sodium carbonate, the sodium salt of nitrilotriacetic acid, sodium citrate, carboxymethylmalonate, carboxymethyloxysuccinate and the water-insoluble crystalline or amorphous aluminosilicate builder materials, or mixtures thereof.

These builder materials may be present at a level of, for example, from 5 to 80% by weight, preferably from 10 to 60% by weight.

When the peroxygen compound and bleach precursor are dispersed in water, a peroxy acid (IV) is generated which should deliver from about 0.1 to about 50 ppm active oxygen per liter of water; preferably oxygen delivery should range from 2 to 15 ppm. Surfactant should be present in the wash water from about 0.05 to 1.0 grams per liter, preferably from 0.15 to 0.20 grams per liter. When present, the builder amount will range from about 0.1 to 3.0 grams per liter.

Apart from the components already mentioned, the detergent compositions of the invention can contain any of the conventional additives in the amounts in which such materials are normally employed in fabric washing detergent compositions. Examples of these additives include lather boosters such as alkanolamides, particularly the monoethanolamides derived from palmkernel fatty acids and coconut fatty acids, lather depressants such as alkyl phosphates and silicones, anti-redeposition agents such as sodium carboxymethylcellulose and alkyl or substituted alkylcellulose ethers, other stabilizers such as ethylene diamine tetraacetic acid, fabric softening agents, inorganic salts such as sodium sulphate, and, usually present in very small amounts, fluorescent agents, perfumes, enzymes such as proteases, cellulses, lipases and amylases, germicides and colorants.

The bleach precursors and their peroxycarbonic acid derivatives described herein are useful in a variety of cleaning products. These include laundry detergents, laundry bleaches, hard surface cleaners, toilet bowl cleaners, automatic dishwashing compositions and even denture cleaners. Precursors of the present invention can be introduced in a variety of product forms including powders, on sheets or other substrates, in pouches, in tablets or in non-aqueous liquids such as liquid nonionic detergents.

The following examples will more fully illustrate the embodiments of this invention. All parts, percentages and proportions referred to herein and in the appended claims are by weight unless otherwise illustrated.

EXAMPLE 1

Preparation of Choline Chloroformate Chloride $[(CH_3)_3N^+CH_2CH_2OCOCl]Cl^-$ Phosgene (113 g, 1.15 moles) was condensed in a 500 ml three-neck flask equipped with an inlet gas dispersion tube, dropping funnel, magnetic stirring bar, and dry ice/acetone condenser topped with a drying tube. The phosgene was contained in a small cylinder and was introduced via the gas dispersion tube. A dry ice/acetone bath was used to keep the phosgene at −30°. Thereinto was added 250 ml dry chloroform (dried over anhydrous calcium chloride for 48 hours) by means of a dropping funnel. Dry, pulverized choline chloride (40 g., 0.29 mole; dried in a vacuum oven at >50° C. for 24 hours) was added thereto. The mixture was stirred rapidly at −30° C. for 1 hour and then allowed to warm to room temperature. Eventually, the reaction mixture separated into two layers. Stirring was continued overnight; hydrogen chloride and any phosgene that escaped during this process was directed to two traps containing 1N sodium hydroxide.

Workup of the reaction mixture was accomplished by removing the dispersion tube and dropping funnel and attaching a single piece distillation unit to the reaction flask. The receiver flask was covered with a blanket of dry ice. All volatiles were removed from the reaction solution by aid of a water aspirator, leaving white, crystalline choline chloroformate chloride. This product was used without further purification.

Attempts were made to obtain the NMR spectrum of choline chloroformate chloride in a variety of solvents. Unfortunately, this compound is soluble only in water, in which decomposition and accompanying decarboxylation interferes severely with spectral quality. As a result, NMR analysis of choline chloroformate could not be reported. However, the infrared spectrum in Nugol showed a representative carbonyl peak at 1765 $cm^{-1}$.

Preparation of 2-(N,N,N-Trimethylammonium)ethyl Sodium 4-Sulfophenyl Carbonate Chloride (SPCC)

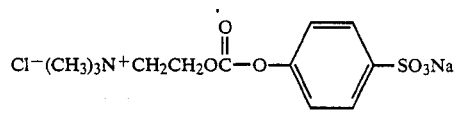

Sodium 4-phenolsulfonate dihydrate (6.4 g, 0.028 mol) and sodium hydroxide (1.1 g, 0.028 mol) were dissolved in 60 ml distilled water. Choline chloroformate chloride (5.6 g, 0.028 mol) was added while stirring the reaction mixture with a high speed stirrer. After all of the choline chloroformate chloride had dissolved (1–2 minutes), the reaction mixture was frozen in dry ice and freeze-dried. The resulting white solid was analyzed by NMR to be >60 mole % of the desired product (SPCC), the major impurities being choline chloride and unreacted sodium 4-phenolsulfonate.

Alternatively, the reaction mixture can be treated with an equal volume of acetone. Thereby the desired product precipitates from solution.

Unreacted p-phenolsulfonate was removed by boiling the crude SPCC in methanol followed by filtration and drying. Typically, 50 g SPCC was added to 500 ml dry ethanol. The mixture was boiled and solid SPCC was collected by filtration and dried to give SPCC essentially free of unreacted sodium p-phenolsulfonate (by 60 MHz NMR).

NMR ($D_2O$, trimethylsilylacetic acid standard): 3.03 (S, 9H); 3.5–3.8 (m, 4H); 7.23 (d, 2H); 7.77 (d, 2H).

EXAMPLE 2

Preparation of 2-(N-benzyl-N,N-dimethylammonium)ethyl Chloroformate Chloride Phosgene (35 ml, 48.5 g, 0.49 mol) was condensed in apparatus identical to that aforedescribed. Dry chloroform (15 ml, dried over anhydrous calcium chloride) was added to the phosgene and the solution held at −30° with a dry ice/acetone bath. Benzyldimethyl-2-hydroxyethyl ammonium chloride (24.6 g, 0.144 mol) in 100 ml dry chloroform was slowly added through the dropping funnel. The reaction mixture was held at −30° until the addition was complete. Thereafter, the reaction mixture was allowed to warm to room temperature and stir overnight.

Workup was carried out as described previously. The yield of crystalline product was 24.6 g (77%). This material was used without further purification.

ir (neat, solid, $cm^{-1}$): 1784, 1488, 1460, 1414, 1376, 1254, 1219, 1163, 875, 773.

Preparation of
2-(N-benzyl-N,N-dimethylammonium)ethyl sodium 4-sulfophenyl Carbonate Chloride (SPBDMC)

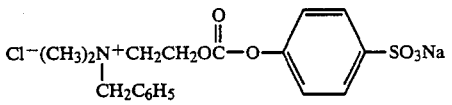

Sodium phenolsulfonate dihydrate (3.94 g, 0.017 mol) and sodium hydroxide (0.68 g, 0.017 mol) were dissolved in distilled water (11 ml) and 2-(N-benzyl-N,N-dimethylammonium)ethyl chloroformate chloride (3.28 g, 0.017 mol) was added while stirring the reaction mixture with a high speed stirrer. After dissolution of the chloroformate, the reaction mixture was quickly diluted to 300 ml with water and freeze-dried. Spectral analysis of the resulting white solid indicated a SPBDMC yield of 47% with unreacted sodium phenolsulfonate and 2-(N-benzyl-N,N-dimethylammonium)ethanol chloride being the principal impurities. The carbonate was used without further purification.

NMR (DMSO/$D_2O$, trimethylsilylacetic acid standard): 7.30 (d, 2H); 7.60 (m, 5H); 7.80 (d, 2H); 3.07 (S, 6H).

ir (neat, solid, $cm^{-1}$): 1766, 1489, 1250, 1212, 1122, 1032, 1010, 704, 616, 567.

EXAMPLE 3

Preparation of
2-(N-butyl-N,N-dimethylammonium)ethyl Chloroformate Bromide

The compound was prepared by the procedure described for 2-(N-benzyl-N,N-dimethylammonium)ethyl chloroformate chloride. For this experiment, the reagents were as follows: 2-(N-butyl-N,N-dimethylammonium)ethanol bromide (10.0 g, $5.5\times10^{-2}$ mol), phosgene (17.5 g, 0.177 mol) and dry chloroform (75 ml). After workup, 2-(N-butyl-N,N-dimethylammonium-)ethyl chloroformate chloride was used without further purification. An infrared spectrum of the product (neat) revealed a carbonyl peak at 1770 $cm^{-1}$.

Preparation of
2-(N-butyl-N,N-dimethylammonium)ethyl Sodium 4-Sulfophenyl Carbonate Bromide (SPPuDMC)

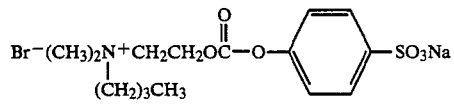

This compound was prepared by the procedure described for 2-(N-benzyl)-N,N-dimethylammonium-)ethyl sodium 4-sulfophenyl carbonate bromide. Typical reagent levels were as follows: 2-(N-butyl-N,N-dimethylammonium)ethyl chloroformate bromide (4.03 g, $17.2\times10^{-2}$ mol), sodium 4-phenolsulfonate dihydrate (4.00 g, $1.72\times10^{-2}$ mol), sodium hydroxide (0.70 g, $1.75\times10^{-2}$ mol), and water (8.0 ml).

Spectral analysis of the white, solid product indicated the SPBuDMC yield was 66% with unreacted sodium phenolsulfonate and 2-(N-butyl-N,N-dimethylammonium)ethyl bromide being the principal impurities. These impurities made assignment of aliphatic peaks in the NMR spectrum difficult and, as a result, only the aromatic proton peak positions of the phenolsulfonate group and nitrogen bound methyl groups in the product are herein reported.

NMR ($D_2O$, trimethylsilylacetic acid standard): 7.7 (d, 2H); 7.2 (d, 2H); 2.9 (5, 6H).

EXAMPLE 4

Preparation of
2-[4-(N,N,N-trimethylammonium)phenyl]Ethanol Chloride

Methylene chloride (50 ml) and 2-[4-(N,N-dimethylamino)-phenyl]ethanol (5.00 g, $3.03\times10^{-2}$ mol) were placed in a 100 ml round-bottom flask equipped with a dropping funnel, condenser, and magnetic stirring bar. Methyl iodide (4.29 g, $3.03\times10^{-2}$ mol) was added dropwise through the dropping funnel. Precipitate began to form immediately. After addition of all of the methyl iodide, the reaction mixture was stirred for an additional 30 minutes. The product was collected by vacuum filtration, washed with methylene chloride, and dried in a vacuum oven. Spectral analysis confirmed the structure of the product as 2-[N,N,N-trimethylammonium)phenyl]ethanol iodide. The iodide salt was converted to the hydroxide salt by passing through a Bio Rad AG21K resin exchanged with sodium hydroxide. Neutralization of the hydroxide salt with dilute hydrochloric acid followed by freeze-drying gave the desired chloride salt.

Preparation of
2-[4-(N,N,N-trimethylammonium)phenyl]ethyl Chloroformate Chloride This compound was prepared by the procedure described for 2-(N-benzyl-N,N-dimethylammonium)ethyl chloroformate chloride. Typical reagent levels were as follows: 2-[4-(N,N,N-trimethylammonium)phenyl]ethanol chloride (4.56 g, $2.12\times10^{-2}$ mol), phosgene (8.40 g, $8.48\times10^{-2}$ mol), and dry chloroform (30 ml).

After workup, 2-[4-(N,N,N-trimethylammonium)-phenyl]ethyl chloroformate chloride was used without further purification.

Preparation of
2-[4-(N,N,N-trimethylammonium)phenyl]ethyl Sodium 4-sulfophenyl Carbonate Chloride (SPTPEC)

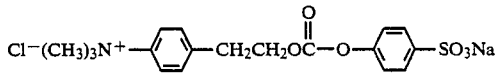

This compound was prepared by the procedure described for 2-(N-benzyl-N,N-dimethylammonium)ethyl sodium 4-sulfophenyl carbonate chloride. Typical reagent levels were as follows: 2-[4-(N,N,N-trimethylammonium)phenyl]ethyl chloroformate chloride (4.10 g, $1.50\times10^{-2}$ mol), sodium 4-phenolsulfonate dihydrate (2.42 g, $1.50\times10^{-2}$ mol), sodium hydroxide (0.59 g, $1.50\times10^{-2}$ mol) and water (6.4 ml).

The product crystallized from the reaction mixture. After drying, spectral analysis confirmed the product structure as 2-[4-(N,N,N-trimethylammonium)phenyl-]ethyl sodium 4-sulfophenyl carbonate chloride. Purity was approximately 65% (by NMR).

The product was purified by boiling in methanol followed by filtration and drying. The NMR spectrum of the purified product showed complete absence of unreacted sodium phenolsulfonate.

NMR ($D_2O$, trimethylsilylacetic acid standard): 7.55 (d, 2H); 7.45 (d, 2H); 7.20 (d, 2H); 7.00 (d, 2H); 4.30 (t, 2H); 3.35 (s, 9H); 2.85 (t, 2H).

ir (solid, photoacoustic $cm^{-1}$): 3023, 1755, 1519, 1462, 1151, 1123, 957, 852, 836, 818

EXAMPLE 5

Preparation of 1,1-Dimethyl-3-hydroxypiperidinium Chloride

This compound was prepared by the procedure described for 2-[4-(N,N,N-trimethylammonium)phenyl]ethanol chloride. Typical reagent levels were as follows: 3-hydroxy-1-methylpiperidine (21.7 g, 0.188 mol), iodomethane (40.0 g, 0.280 mol) and methylene chloride (50 ml).

NMR ($D_2O$, TMS external standard): 4.10 (m, 1H); 3.30 (m, 2H); 3.16 (s, 3H); 3.03 (s, 3H); 2.13–1.16 (m, 4H).

Preparation of 1,1-Dimethylpiperidinium-3-chloroformate Chloride

This compound was prepared by the procedure described for 2-(N-benzyl-N,N-dimethylammonium)ethyl chloroformate chloride. Typical reagent levels were as follows: 1,1-dimethyl-3-hydroxypiperidinium chloride (24.0 g, 0.124 mol), phosgene (41.6 ml, 0.583 mol) and dry chloroform (100 ml).

After workup, 1,1-dimethylpiperidinium-3-chloroformate chloride was used without further purification.

Preparation of Sodium 3-(1,1-Dimethylpiperidinium) 4-Sulfophenyl Carbonate Chloride (SPDPC)

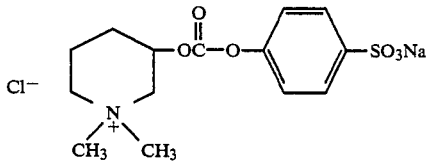

This compound was prepared by the procedure described for 2-(N-benzyl-N,N-dimethylammonium)ethyl sodium 4-sulfophenyl carbonate chloride. Typical reagent levels were as follows: 1,1-dimethylpiperidinium-3-chloroformate chloride (4.65 g, $2.19\times10^{-2}$ mol); sodium 4-sulfophenol dihydrate (5.10 g, $2.19\times10^{-2}$ mol), sodium hydroxide (0.88 g, $2.20\times10^{-2}$ mol), and water (10 ml).

Spectral analysis of the white solid product indicated the SPDPC yield was approximately 70%, with major impurities being unreacted sodium 4-sulfophenol and 1,1-dimethyl-3-hydroxypiperidinium chloride.

NMR ($D_2O$, TMS external standard): 7.56 (d, 2H); 7.08 (d, 2H); 9.92 (m, 1H); 3.52–2.96 (m, 4H); 2.86 (s, 3H); 2.83 (s, 3H); 1.72 (m, 4H).

EXAMPLE 6

Preparation of 1,1-Dimethyl-4-hydroxypiperidinium Chloride

This compound was prepared by the procedure described for 2-[4-(N,N,N-trimethylammonium)phenyl]ethanol chloride. Typical reagent levels were as follows: 4-hydroxy-1-methylpiperidine (21.7 g, 0.188 mol), iodomethane (40.0 g, 0.280 mol), and methylene chloride (50 ml).

NMR ($D_2O$, TMS external standard): 3.96 (m, 1H); 3.40 (m, 4H); 3.12 (s, 6H); 2.00 (m, 4H).

Preparation of 1,1-Dimethylpiperidinium-4-chloroformate Chloride

This compound was prepared by the procedure described for 2-(N-benzyl-N,N-dimethylammonium)ethyl chloroformate chloride. Typical reagent levels were as follows: 1,1-dimethyl-4-hydroxypiperidinium chloride (24.0 g, 0.145 mol), phosgene (41.6 ml, 0.583 mol), and dry chloroform (100 ml).

After workup, the product was used without further purification.

Preparation of Sodium 4-(1,1-dimethylpiperidinium) 4-sulfophenyl Carbonate Chloride (SPDMPC)

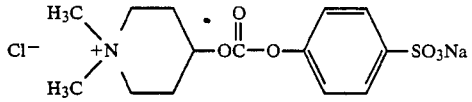

This compound was prepared by the procedure described for 2-(N-benzyl-N,N-dimethylammonium)ethyl sodium 4-sulfophenyl carbonate chloride. Typical reagent levels were as follows: 1,1-dimethylpiperidinium-4-chloroformate chloride (4.65 g, $2.19\times10^{-2}$ mol), sodium 4-sulfophenol dihydrate (5.10 g, $2.19\times10^{-2}$ mol), sodium hydroxide (0.88 g, $2.20\times10^{-2}$ mol), and water (10 ml).

The white solid product was purified by boiling in ethanol followed by filtration and drying to give a solid containing no unreacted sodium 4-sulfophenol nor 1,1-dimethyl-4-hydroxypiperidinium chloride by NMR analysis.

NMR ($D_2O$, trimethylsilylacetic acid standard): 7.75 (d, 2H); 7.22 (d, 2H); 5.10 (m, 1H); 3.44 (m, 4H); 3.14 (s, 3H); 3.10 (s, 3H); 2.24 (m, 4H).

EXAMPLE 7

Preparation of 2-(N,N,N-trimethylammonium)ethyl 4-Nitrophenyl Carbonate Chloride (STNC)

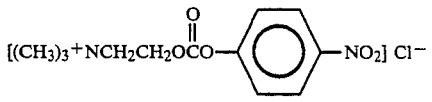

This compound was prepared by the procedure described for 2-(N-benzyl-N,N-dimethylammonium)ethyl sodium 4-sulfophenyl carbonate bromide. Typical reagent lvels were as follows: 2-(N,N,N-trimethylammonium)ethyl chloroformate chloride (7.0 g, $3.5\times10^{-2}$ mol), 4-nitrophenol (4.8 gms, $3.5\times10^{-2}$ mol), sodium hydroxide (1.4 gms, $3.5\times10^{-2}$ mol) and water (15 ml).

Spectral analysis of the white, solid indicated the product yield was greater than 90% with 4-nitrophenol and choline chloride being the principal impurities. The product was used without further purification.

NMR ($D_2O$, TMS external standard): 3.5–3.8 (m, 4H); 3.05 (s, 9H); 7.23 (d, 2H); 8.18 (d, 2H).

EXAMPLE 8

Peracid Generation From Precursors

Peroxycarbonic acid precursors described herein can be used to generate peroxycarbonic acid bleaches in basic aqueous solution containing a source of hydrogen peroxide and, optimally, may contain typical detergent ingredients. Peroxycarbonic acid generation was demonstrated by adding a premeasured sample of precursor to 500 ml aqueous buffer solution at the desired pH, heated to 40° in a thermojacketed beaker, and containing the approximate level of hydrogen peroxide (added as either 30% hydrogen peroxide or sodium perborate monohydrate). The hydrogen peroxide source was added just prior to addition of the precursor. Ten milliliter aliquots of solution were withdrawn from the beaker at regular intervals and were added to a 250 ml titration flask containing crushed ice (150 g), glacial acetic acid (30 ml) and 4% aqueous potassium iodide (5 ml). After development for ten minutes with occasional agitation, the iodine produced was titrated with standard sodium thiosulfate solution. Time zero was taken as the point of introduction of precursor into the peroxide solution. Precursor perhydrolysis experiments were generally carried out for a maximum of 15 minutes.

Since hydrogen peroxide itself contributes to the total active oxygen in these titrations, controls or "blanks" were obtained by carrying out a perhydrolysis experiment in the absence of precursor. These hydrogen peroxide blanks were substracted from the total active oxygen titration in the presence of bleach precursor to give the level of active oxygen produced by precursor perhydrolysis.

Peroxycarbonic acid generation was determined at pH 8, 9, and 10. Borax buffer was used for experiments at pH 9 and 10 while phosphate buffer was employed for experiments carried out at pH 8. Adjustment of the buffer systems at 40° C. to the exact pH was carried out with 1M hydrochloric acid or sodium hydroxide solution.

Tables I and II list the peroxycarbonic acid yields as a percent of theoretical from SPCC and SPBCMC, respectively.

TABLE I

| | Perhydrolysis Yields From SPCC | | | | |
|---|---|---|---|---|---|
| pH | 1 Minute | 3 Minutes | 5 Minutes | 10 Minutes | 15 Minutes |
| 8 | 29% | 28% | 9% | 6% | 0% |
| 9 | 29% | 38% | 29% | 25% | 13% |
| 10 | 17% | 16% | 24% | 13% | 15% |

Conditions: 40° C., [SPCC] = $9.4 \times 10^{-4}$ M, [$H_2O_2$]= $9.4 \times 10^{-3}$ M.

TABLE II

| | Perhydrolysis Yields From SPBDMC | | | | |
|---|---|---|---|---|---|
| pH | 1 Minute | 3 Minutes | 5 Minutes | 10 Minutes | 15 Minutes |
| 8 | 21% | 34% | 7% | 2.4% | 0% |
| 9 | 49% | 32% | 8% | 0% | 0% |

Conditions: 40° C., [SPBDMC] = $9.4 \times 10^{-4}$ M, [$H_2O_2$] = $9.4 \times 10^{-3}$ M.

From the data in Tables I and II, it can be seen that precursors SPCC and SPBDMC generate peroxycarbonic acid rapidly. Peracid is generated quickly even at pH 8. Peroxycarbonic acid decomposition during the perhydrolysis results in less than quantitative yields based on precursor level.

EXAMPLE 9

Bleaching From Peroxycarbonic Acid Precursor/Peroxide Systems

The stain bleaching ability of peroxycarbonic acids generated from the synthesized precursors was demonstrated on common stains such as tea, red wine, and blackberry juice. Typically, cotton test pieces (4 in.×4 in.) stained with the appropriate stain were washed in a Terg-O-Tometer in 1 l. of aqueous solution containing a given level of bleach precursor, hydrogen peroxide, buffer, and surfactant (generally sodium dodecylbenzenesulfonate).

Washes were carried out at 40° C. for 15 minutes. Stain bleaching was measured reflectometrically using a Colorgard System/05 Reflectometer. Bleaching is indicated by an increase in reflectance, reported as ΔR. In general, a ΔR of one unit is perceivable in a paired comparison while ΔR of two units is perceivable monadically. In reporting the reflectance change, the change in reflectance caused by general detergency and bleaching by the excess hydrogen peroxide has been accounted for. Thus ΔR can actually be expressed as: ΔR=(Reflectance of stained fabric washed with precursor/$H_2O_2$ and detergent—Reflectance of stained fabric before washing)—(Reflectance of stained fabric washed with $H_2O_2$ and detergent alone—Reflectance of stained fabric before washing).

In the case of spaghetti stain, bleaching is measured as "Δb" where the quantity "Δb" is the change in the b-axis of the Hunter color scale. The spaghetti stain is initially yellow and loses color with bleaching and thus bleaching produces a negative change in b. Since peroxide-only controls were also carried out with the spaghetti sauce stains, percarbonic acid bleaching is actually reported as "Δb".

TABLE III

| Bleach Performance | | | | | |
|---|---|---|---|---|---|
| | | | ΔR | | |
| [SPCC] M | [$H_2O_2$] M | T, °C. | Tea | Red Wine | Blackberry |
| $9.4 \times 10^{-4}$ | $9.4 \times 10^{-3}$ | 40 | 19.5 | 25.1 | 15.3 |
| $6.3 \times 10^{-4}$ | $9.4 \times 10^{-3}$ | 40 | 15.4 | 18.5 | 13.9 |
| $3.1 \times 10^{-4}$ | $9.4 \times 10^{-3}$ | 40 | 9.5 | 10.9 | 13.0 |
| $9.4 \times 10^{-4}$ | $4.7 \times 10^{-3}$ | 40 | 21.0 | 23.3 | — |
| $9.4 \times 10^{-4}$ | $1.9 \times 10^{-3}$ | 40 | 19.0 | 23.9 | — |
| $9.4 \times 10^{-4}$ | $9.4 \times 10^{-4}$ | 40 | 13.0 | 17.8 | — |
| $9.4 \times 10^{-4}$ | $1.9 \times 10^{-3}$ | 20 | 9.7 | 10.7 | — |

TABLE III-continued

| Bleach Performance | | | | | | |
|---|---|---|---|---|---|---|
| $9.4 \times 10^{-4}$ | $1.9 \times 10^{-3}$ | | 15 | 7.1 | 8.6 | — |
| $9.4 \times 10^{-4}$ | $1.9 \times 10^{-3}$ | | 10 | 4.3 | 8.4 | — |
| | | | ΔR | | | Δb |
| Structure | Precursor M | $[H_2O_2]$ M | T, °C. | Tea | Red Wine | Spaghetti |
| SPBDMC | $7.5 \times 10^{-4}$ | $3.5 \times 10^{-3}$ | 40 | 13.5 | 15.7 | — |
| SPBuDMC | $9.4 \times 10^{-4}$ | $9.4 \times 10^{-3}$ | 40 | 9.7 | 12.9 | 0 |
| SPTPEC | $9.4 \times 10^{-4}$ | $9.4 \times 10^{-3}$ | 40 | 18.9 | 21.9 | 2.5 |
| SPDPC | $9.4 \times 10^{-4}$ | $1.9 \times 10^{-3}$ | 40 | 16.4 | 18.4 | — |
| | | | 20 | 8.0 | 8.7 | — |
| | | | 15 | 4.8 | 5.5 | — |
| | | | 10 | 5.2 | 7.3 | — |
| SPDMPC | $9.4 \times 10^{-4}$ | $1.9 \times 10^{-3}$ | 40 | 13.4 | 13.3 | — |
| | | | 20 | 6.0 | 5.7 | — |
| | | | 15 | 3.0 | 4.4 | — |
| | | | 10 | 2.8 | 3.3 | — |
| STNC | $9.4 \times 10^{-4}$ | $9.4 \times 10^{-3}$ | 40 | 15.9 | 9.3 | — |
| | | | 15 | 12.1 | 9.4 | — |

It can be seen that bleaching from these peroxycarbonic acid bleaches is excellent, giving substantial stain removal on a variety of stains. As evidenced from Table, the SPCC system has been studied most extensively. A number of observations may be gleaned from the Table with respect to SPCC. At a theoretical percarbonic acid yield of 15 ppm active oxygen ($9.4 \times 10^{-4}$M), outstanding bleaching is obtained at 40° in 15 minutes on hydrophilic stains such as tea, red wine and blackberry. Bleaching remains outstanding at hydrogen peroxide/precursor ratios as low at 2:1. Even at 1:1, bleaching is very good compared to state-of-the-art systems such as sodium nonanoyloxybenzene sulfonate with perborate. At a theoretical percarbonic acid yield of 5 ppm active oxygen ($3.1 \times 10^{-4}$M), bleaching of hydrophilic stains is comparable to that obtained with sodium nonanoyloxybenzene sulfonate with perborate at 10 ppm active oxygen theoretical peracid. Levels of 15 ppm active oxygen give very good bleaching at 20° C. and perceivable bleaching even as low as 10° C.

Precursors other than SPCC all gave very good to outstanding bleaching on tea and red wine stains at 40° C. and 15 ppm active oxygen theoretical percarbonic acid yield. Most interestingly, SPTPEC gave a modest but perceptible bleaching on spaghetti sauce stain. The observation is unusual in that this stain is hydrophobic whereas the class is most effective against hydrophilic stains. Equally interesting is the observation that SPDPC and SPDMPC are effective in cold water. These results indicate that low temperature bleaching is a general property of percarbonic acids substituted with quaternary ammonium functionality.

The foregoing description and examples illustrate selected embodiments of the present invention. In light thereof, various modifications will be suggested to one skilled in the art, all of which are within the spirit and purview of this invention.

What is claimed is:

1. A bleach precursor compound having the formula:

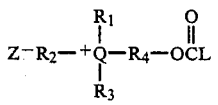

(I)

wherein:

$R_1$, $R_2$ and $R_3$ are each a radical selected from the group consisting of alkyl, alkenyl, alkynyl, cycloalkyl, cycloalkenyl, alkaryl, aryl, phenyl, hydroxyalkyl, polyoxyalkylene, and $R_4OCOL$;

or two or more of $R_1$, $R_2$, and $R_3$ together form an alkyl substituted or unsubstituted nitrogen-containing heterocyclic ring system;

or at least one of $R_1$, $R_2$, and $R_3$ is attached to $R_4$ to form an alkyl substituted or unsubstituted nitrogen-containing heterocyclic ring system;

$R_4$ is selected from a bridging group consisting of alkylene, cycloalkylene, alkylenephenylene, phenylene, arylene, and polyalkoxylene; and wherein the bridging group can be unsubstituted or substituted with $C_1$–$C_{20}$ atoms selected from alkyl, alkenyl, benzyl, phenyl and aryl radicals;

$Z^-$ is a monovalent or multivalent anion leading to charge neutrality when combined with $Q^+$ in the appropriate ratio and wherein $Z^-$ is sufficiently oxidatively stable not to interfere significantly with bleaching by a peroxy carbonic acid;

Q is nitrogen or phosphorous; and

L is selected from the group consisting of:

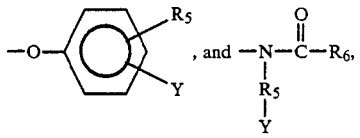

wherein $R_5$ and $R_6$ are a $C_1$–$C_{12}$ alkyl group, and Y is H.

2. The precursor of claim 1 wherein Q is nitrogen and $R_1$, $R_2$ and $R_3$ are each the same or different and selected from $C_1$–$C_{20}$ atom radicals selected from the group consisting of alkyl, alkylaryl, benzyl, hydroxyalkyl, and heterocyclic rings containing the quaternary nitrogen where $R_1$ and $R_4$ or $R_1$ and $R_2$ are joined together, and mixtures of groups thereof.

3. The precursor of claim 2 wherein $R_1$ is selected from short-chain $C_1$–$C_4$ alkyl radicals.

4. The precursor of claim 3 wherein $R_2$ and $R_3$ are each a longer chain $C_7$–$C_{20}$ alkyl or alkylaryl radical.

5. The precursor of claim 4 wherein said longer chain radical is selected from the group consisting of benzyl, lauryl and stearyl groups.

6. The precursor of claim 1 wherein $R_4$ is selected from a bridging group consisting of $C_2$–$C_{20}$ alkylene, $C_6$–$C_{12}$ phenylene, $C_5$–$C_{20}$ cycloalkylene, and $C_8$–$C_{20}$ alkylphenylene groups.

7. The precursor of claim 6 wherein the $R_4$ bridging group is a $C_2$–$C_6$ alkylene or $C_6$–$C_{12}$ phenylene group.

8. The precursor of claim 2 wherein said heterocyclic ring is selected from pyridine, morpholine, pyrrolidone, piperidine and piperazine.

9. A bleaching-detergent composition comprising:

(i) from 1 to 60% of a peroxygen compound capable of yielding hydrogen peroxide in an aqueous solution;

(ii) from 0.1 to 40% of a bleach precursor having the formula:

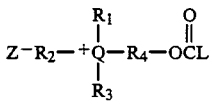

(I)

wherein:

$R_1$, $R_2$ and $R_3$ are each a radical selected from the group consisting of alkyl, alkenyl, alkynyl, cycloalkyl, cycloalkenyl, alkaryl, aryl, phenyl, hydroxyalkyl, polyoxyalkylene, and $R_4OCOL$;

or two or more of, $R_1$, $R_2$, and $R_3$ together form an alkyl substituted or unsubstituted nitrogen-containing heterocyclic ring system;

or at least one of $R_1$, $R_2$, and $R_3$ is attached to $R_4$ to form an alkyl substituted or unsubstituted nitrogen-containing heterocyclic ring system;

$R_4$ is selected from a bridging group consisting of alkylene, cycloalkylene, alkylenephenylene, phenylene, arylene, and polyalkoxylene; and wherein the bridging group can be unsubstituted or substituted with $C_1$–$C_{20}$ atoms selected from alkyl, alkenyl, benzyl, phenyl and aryl radicals;

$Z^-$ is a monovalent or multivalent anion leading to charge neutrality when combined with $Q^+$ in the appropriate ratio and wherein $Z^-$ is sufficiently oxidatively stable not to interfere significantly with bleaching by a peroxy carbonic acid;

Q is nitrogen or phosphorous; and

L is a leaving group selected from the group consisting of:

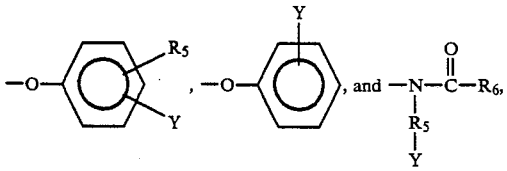

wherein $R_5$ and $R_6$ are a $C_1$–$C_2$ alkyl group, and Y is H;

(iii) from 0 to 50% of a surfactant selected from the group consisting of nonionic, anionic, amphoteric and surface active mixtures thereof; and (iv) from 0 to 80% of a detergent builder.

10. The composition of claim 9 wherein the surfactant ranges from 4 to 50% and the detergent builder ranges from 5 to 70% by weight.

11. The composition of claim 9 wherein Q is nitrogen and $R_1$, $R_2$ and $R_3$ are each the same or different and selected from $C_1$–$C_{20}$ atom radicals selected from the group consisting of alkyl, alkylaryl, benzyl, hydroxyalkyl, and heterocyclic rings containing the quaternary nitrogen where $R_1$ and $R_4$ or $R_1$ and $R_2$ are joined together, and mixtures of groups thereof.

12. The composition of claim 11 wherein $R_1$ is selected from short-chain $C_1$–$C_4$ alkyl radicals.

13. The composition of claim 12 wherein $R_2$ and $R_3$ are each a longer chain $C_7$–$C_{20}$ alkyl or alkylaryl radical.

14. The composition of claim 13 wherein said longer chain radical is selected from the group consisting of benzyl, lauryl and stearyl groups.

15. The composition of claim 9 wherein $R_4$ is selected from a bridging group consisting of $C_2$–$C_{20}$ alkylene, $C_6$–$C_{12}$ phenylene, $C_5$–$C_{20}$ cycloalkylene, and $C_8$–$C_{20}$ alkylphenylene groups.

16. The composition of claim 15 wherein the $R_4$ bridging group is a $C_2$–$C_6$ alkylene or $C_6$–$C_{12}$ phenylene group.

17. The composition of claim 11 wherein said heterocyclic ring is selected from pyridine, morpholine, pyrrolidone, piperidine and piperazine.

18. A peroxy acid compound according to the formula:

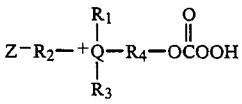

(II)

wherein:

$R_1$, $R_2$ and $R_3$ are each a radical selected from the group consisting of alkyl, alkenyl, alkynyl, cycloalkyl, cycloalkenyl, alkaryl, aryl, phenyl, hydroxyalkyl, polyoxyalkylene, and mixtures thereof;

or two or more of $R_1$, $R_2$, and $R_3$ together form an alkyl substituted or unsubstituted nitrogen-containing heterocyclic ring system;

or one of $R_1$, $R_2$and $R_3$ is attached to $R_4$ to form an alkyl substituted or unsubstituted nitrogen-containing heterocyclic ring system;

$R_4$ is selected from a bridging group consisting of alkylene, cycloalkylene, alkylenephenylene, phenylene, arylene, and polyalkoxylene; and wherein the bridging group can be unsubstituted or substituted with $C_1$–$C_{20}$ atom selected from alkyl, alkenyl, benzyl, phenyl and aryl radicals;

$Z^-$ is a monovalent or multivalent anion leading to charge neutrality when combined with $Q^+$ in the appropriate ratio and wherein $Z^-$ is sufficiently oxidatively stable not to interfere significantly with bleaching by a peroxy carbonic acid; and Q is nitrogen or phosphorous.

19. The peroxy acid of claim 18 wherein Q is nitrogen and $R_1$, $R_2$ and $R_3$ are each the same or different and selected from $C_1$–$C_{20}$ atom radicals selected from the group consisting of alkyl, alkylaryl, benzyl, hydroxyalkyl, and heterocyclic rings containing the quaternary nitrogen where $R_1$ and $R_4$ or $R_1$ and $R_2$ are joined together, and mixtures of groups thereof.

20. The peroxy acid of claim 19 wherein $R_1$ is selected from short-chain $C_1$–$C_4$ alkyl radicals.

21. The peroxy acid of claim 20 wherein $R_2$ and $R_3$ are each a longer chain $C_7$–$C_{20}$ alkyl or alkylaryl radical.

22. The peroxy acid of claim 21 wherein said longer chain radical is selected from the group consisting of benzyl, lauryl and stearyl groups.

23. The peroxy acid of claim 18 wherein $R_4$ is selected from a bridging group consisting of $C_2$–$C_{20}$ alkylene, $C_6$–$C_{12}$ phenylene, $C_5$–$C_{20}$ cycloalkylene, and $C_8$–$C_{20}$ alkylenephenylene groups.

24. The peroxy acid of claim 18 wherein the $R_4$ bridging group is a $C_2$–$C_6$ alkylene or $C_6$–$C_{12}$ phenylene group.

25. The peroxy acid of claim 18 wherein said heterocyclic ring is selected from pyridine, morpholine, pyrrolidone, piperidine and piperazine.

26. The peroxy acid of claim 18 wherein the compound is sodium 2-(N,N,N-trimethylammonium)ethyl peroxycarbonic acid.

27. The peroxy acid of claim 18 wherein the compound is sodium 2-(N-benzyl-N,N-dimethylammonium-)ethyl peroxycarbonate acid.

28. The peroxy acid of claim 18 wherein the compound is sodium 2-(N-butyl-N,N-dimethylammonium-)ethyl peroxycarbonic acid.

29. The peroxy acid of claim 18 wherein the compound is sodium 2-[4-(N,N,N-trimethylammonium)-phenyl]ethyl peroxycarbonic acid.

30. The peroxy acid of claim 18 wherein the compound is sodium 3-(1,1-dimethylpiperidinium)peroxycarbonic acid.

31. The peroxy acid of claim 18 wherein the compound is sodium 4-(1,1-dimethylpiperidinium)peroxycarbonic acid.

32. The peroxy acid of claim 18 wherein the compound is sodium 2-(N,N,N-trimethylammonium)ethyl peroxycarbonic acid.

33. The peroxy acid of claim 18 wherein the compound is sodium 2-(N-benzyl-N,N-dimethylammonium-)ethyl peroxycarbonic acid.

34. An aqueous bleaching medium comprising a peroxy acid according to claim 18 present in an amount to deliver from about 0.1 to about 50 ppm of active oxygen per liter of medium, and 0.05 to 1.0 grams of a surfactant per liter of the medium.

35. An aqueous bleaching medium according to claim 34 wherein the peroxy acid is present in an amount to deliver from about 2 to 15 ppm of active oxygen per liter of the medium.

36. An aqueous bleaching medium according to claim 34 wherein the surfactant is present from about 0.15 to 0.20 grams per liter of the medium.

37. An aqueous bleaching medium according to claim 34 further comprising a builder from about 0.1 to 3.0 grams per liter of the medium.

38. An aqueous bleaching medium according to claim 34 wherein the surfactant is selected from the group consisting of nonionic, anionic, zwitterionic, amphoteric and surface active mixtures thereof.

39. A bleaching-detergent composition comprising:
(i) from 0.1 to 40% of the peroxy acid of claim 18;
(ii) from 0 to 50% of a surfactant; and
(iii) from 0 to 80% of a detergent builder.

40. The composition of claim 39 wherein the surfactant ranges from 4 to 50% and the detergent builder ranges from 5 to 70% by weight.

41. The composition of claim 40 wherein the surfactant is selected from the group consisting of nonionic, anionic, cationic, amphoteric and surface active mixtures thereof.

* * * * *